United States Patent [19]

Kettlestrings et al.

[11] 4,258,493

[45] Mar. 31, 1981

[54] ADVERTISING DISPLAY MEANS AND METHOD

[75] Inventors: John S. Kettlestrings, Wheaton; Cecil J. Bailey, Montgomery, both of Ill.

[73] Assignee: Cling Cal Corporation, Carol Stream, Ill.

[21] Appl. No.: 36,007

[22] Filed: May 4, 1979

[51] Int. Cl.[3] ..... G09F 07/00

[52] U.S. Cl. ..... 40/600; 24/73 MS; 24/201 B; 400/23 R; 400/617

[58] Field of Search ..... 40/600, 621, 617, 907, 40/11 R, 11 A, 23 R; 24/DIG. 8, DIG. 11, 73 MS, 201 B; 248/467, 206 A; 35/7 A; 335/285, 286, 306

[56] References Cited

U.S. PATENT DOCUMENTS

| | | | |
|---|---|---|---|
| 2,448,611 | 9/1948 | Martin | 24/201 B |
| 2,601,424 | 6/1952 | Baker | 24/49 |
| 2,677,910 | 5/1954 | Morgan | 40/621 X |
| 3,350,045 | 10/1967 | Mayers | 248/205 A |
| 3,529,328 | 9/1970 | Davison | 24/137 |
| 3,827,020 | 7/1974 | Okamoto | 335/285 |
| 3,942,147 | 3/1976 | Josephson | 40/621 X |
| 4,023,290 | 5/1977 | Josephson | 35/7 A |

FOREIGN PATENT DOCUMENTS

| | | | |
|---|---|---|---|
| 1564380 | 4/1969 | France | 40/621 |
| 395722 | 12/1965 | Switzerland | 40/621 |

*Primary Examiner*—John F. Pitrelli
*Assistant Examiner*—G. Lee Skillington
*Attorney, Agent, or Firm*—Hill, Van Santen, Steadman, Chiara, Simpson

[57] ABSTRACT

A method and device for temporarily supporting advertising pieces or the like on a vertical surface. The device includes a flexible backing band having a pair of spaced, parallel permanent magnet strips secured thereto. The magnet strips are of opposite polarity and arranged to clamp an advertising piece therebetween when the flexible band is folded over to position the magnets in an aligned facing orientation. A pressure sensitive adhesive layer is provided on the flexible band to affix the device to a suitable vertical surface to display the advertising piece.

8 Claims, 14 Drawing Figures

ADVERTISING DISPLAY MEANS AND METHOD

BACKGROUND OF THE INVENTION

1. Field of the Invention

This invention is directed to an advertising display piece support and more particularly to a method and device for temporarily securing a sales piece or other information sheets to a vertical surface.

2. Prior Art

Present methods of temporarily supporting or mounting advertising materials such as signs and the like to a generally vertical display surface most often includes the use of either tacks or pressure sensitive plastic tapes, either of which are not totally satisfactory. For example, in instances where a sign is to be displayed in a store window a plastic adhesive tape is genreally used to affix the advertising piece to the glass. While the tape is easily removed from the glass it cannot be easily removed from a paper or cardboard sign. In a short time the signs become stained and tattered after they have been taken down and replaced several times in order to accommodate washing the windows, etc.

Obviously, with large signs it becomes very difficult to position the sign in a window and while holding it in a leveled position pull off a length of tape from a tape roll and apply the tape to the sign. It often happens that the sign will slip while taping to the window and must be rehung with further damaging of the sign.

Many signs which require frequent changing such as "closed" or "open" signs are often only propped up in an out of the way corner of the window where it may go unnoticed, rather then having to bother with the use of tape.

Wires stretched across the window with a sign suspended therefrom have been used infrequently, largely due to problems with mounting the wire and aesthetic considerations.

When thumbtacks are used to temporarily mount a sign or the like to a suitable surface, unsightly holes are produced in the mounting surface and with larger paper signs, tacks often do not provide sufficient areas of support and sign damage is likely to occur.

With display material becoming more and more costly, especially hand lettered signs, it becomes more important to make full use of advertising materials. Accordingly it would be a decided advance in the state of the art to provide a method and device for temporarily supporting an advertising display piece from a variety of display surfaces which is simple to use and does not damage either the display piece or the display surface.

SUMMARY OF THE INVENTION

A device and method for use in temporarily supporting an advertising piece such as a sign or the like from a generally vertical display mounting surface. The device includes two parallel, spaced permanent magnet strips of opposite polarity secured to a flexible backing band with a pressure sensitive adhesive layer provided on a portion of the backing band to accommodate affixing the device to a generally vertical display surface. A releasable protective strip protects the adhesive surface prior to mounting the supporting device to the vertical surface.

In use, an advertising piece may be clamped between the magnet strips and the protective strip then removed to expose the adhesive surface which is then pressed against the mounting surface. Alternatively, the supporting device may be first affixed to the vertical surface and then the sign clamped between the magnets. This is especially advantageous when a long sign is to be hung, requiring a plurality of the supporting devices. Herein, the devices are affixed to the surface in spaced, horizontal alignment by measuring from a suitable reference point. The sign is then positioned between the magnet strips of each of the devices in order.

Since the supporting devices are affixed to the vertical surface in horizontal alignment, the sign will be automatically leveled when supported from the spaced devices.

When the sign is to be taken down a pull tab portion of the flexible backing band is used to separate the magnet strips and release the advertising piece. Thereafter the same advertising piece may be rehung or a new sign hung in its place from the same supporting device or devices.

The supporting device may be modified to include a soft, spongy strip interposed between one of the magnet strips and the flexible backing band to accommodate mounting the supporting device on a somewhat uneven vertical surface. Herein, the spongy layer surface which carries an adhesive layer can conform to irregularities in the vertical surface while the opposite spongy layer surface allows the magnet strip to retain a generally flat orientation to match the second magnet strip for ideal clamping action.

A further modification of the invention provides a horizontally elongated supporting device with comparable elongated magnet strips to provide a generally continuous support along the entire top of a sign. This is especially useful in supporting heavier and thicker signs. Further, the supporting device or a portion of the device may also be utilized to secure various objects to ferrous surfaces.

DESCRIPTION OF THE PREFERRED EMBODIMENTS

Figure 1:
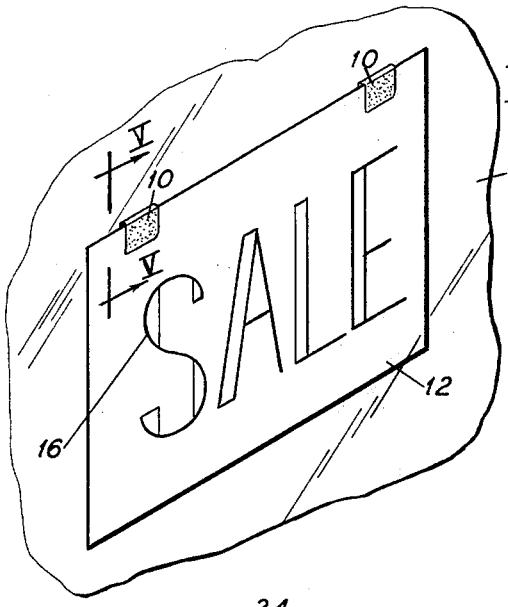
FIG. 1 is a perspective view of a store window showing a pair of supporting devices embodying features of the invention for temporarily supporting an advertising piece on the window.

As shown in the drawings, our invention provides a temporary supporting device 10 for displaying an advertising piece or the like on a verical surface. As best seen in FIG. 1, a pair of supporting devices 10 are arranged to affix a sign 12 to the inside of a window 14 to display an advertising message 16 for viewing from the outside of the window.

Figure 2:
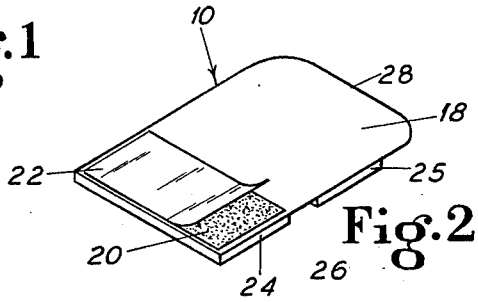
FIG. 2 is an enlarged perspective view of one of the supporting devices of FIG. 1, prior to being placed in use.
Figure 3:
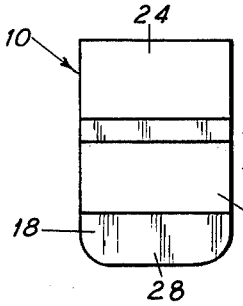
FIG. 3 is an elevational view of the supporting device of FIG. 2, showing the clamping faces of the spaced magnet strips as attached to the flexible backing band.
Figure 4:
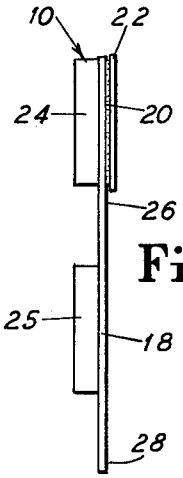
FIG. 4 is an enlarged end elevational view of the supporting device shown in FIG. 3.

The supporting device 10 includes a flexible backing band 18 having a pressure sensitive adhesive layer 20 at one end thereof with a removable protective strip 22, as best seen in FIGS. 2 and 4, overlying the adhesive layer 20 until the device 10 is placed in use. The protective strip 22 is removed to expose the adhesive layer 20 which may then be pressed against the glass surface 14 for supporting engagement therewith.

Figure 5:
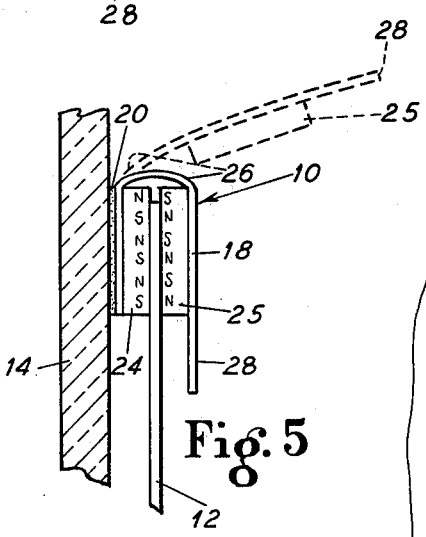
FIG. 5 is an enlarged sectional view taken along the line V—V of FIG. 1.

The device 10 also includes a pair of permanent magnet strips 24, 25 which are bonded to the backing band 18 in a spaced parallel relationship relative to one another, and being of attracting polarity when brought into clamping orientation as shown in FIG. 5. A hinge portion 26 of the flexible backing band 18 when folded over clamps the sign 12 between the magnet strips 24, 25. The backing band is preferably formed of a high strength durable plastic sheet material and in some instances produced with a sufficient stiffness to remain in an "open" position, shown in the broken lines of FIG. 5 to accommodate inserting the sign 12 between the magnet strips 24, 25, especially in instances where the device 10 has been affixed to the window before the sign is hung.

The permanent magnet strips 24, 25 may be of any suitable type but preferably would be made of a barium ferrite impregnated pliable material having a series of spaced magnetized bands extending across the length of each strip. As best seen in FIG. 5 the strips 24 and 25 are each provided with alternating polar regions which when brought into face-to-face alignment provide a very strong magnetic attraction therebetween. These magnet strips may be bent or twisted to conform to irregular surfaces if required without loss of its magnetic energy. Further, providing a series of elongated pole regions on each magnet strip face provides extra holding power as well as insuring longitudinal aligning of the strip along their full length.

A pull tab extension 28 of the flexible backing band accommodates separating the magnet strip 24, 25 to release their hold on the sign 12. Obviously, the supporting devices 10 may remain affixed to the window glass 14 indefinitely; even when the windows are washed. After washing, the sign 12 may then be rehung or a new advertising piece hung in its place.

Figure 6:
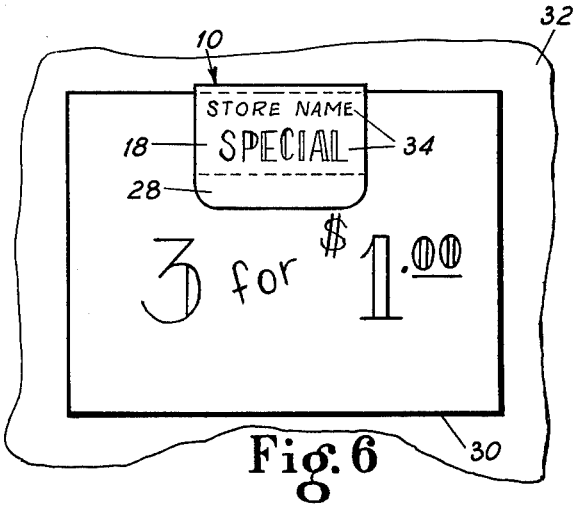
FIG. 6 is a front elevational view showing another application in utilizing the supporting device of the invention.

FIG. 6 illustrates how a single supporting device 10 may be used to display a pricing sign 30 or other information pieces for viewing from the pull tab side of the supporting device 10. Therein the device may be affixed to a vertical support surface 32, such as a display rack or shelving. The flexible backing band 18 may be imprinted with appropriate indicia 34 which does not require frequent changing.

Figure 7:
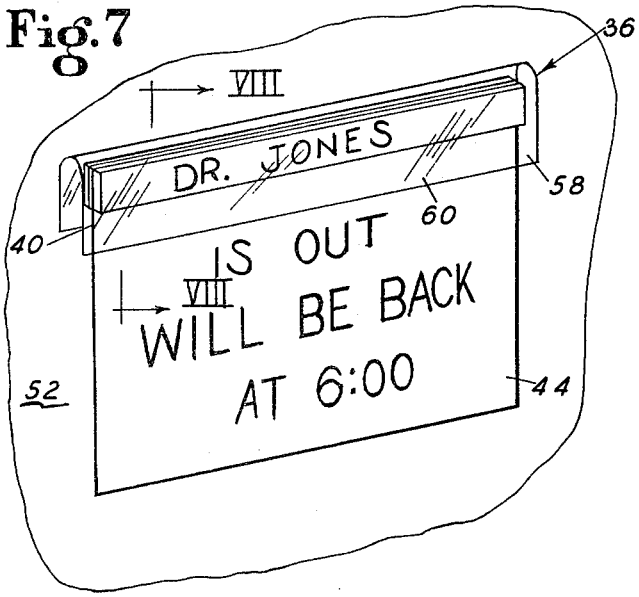
FIG. 7 is a perspective view showing another embodiment of the invention.

Referring now to FIG. 7, an alternate embodiment is shown comprising an elongated supporting device 36, similar to the supporting device 10 but including a soft, spongy, pliable strip 38 secured to a flexible backing band 40 and arranged to support a first magnet strip 42 similar to the magnet strip 24. A second magnet strip 43, similar to the strip 25, is carried directly on the flexible band 40 for positioning in an aligned orientation relative to the magnet strip 42 to clamp a display piece 44 therebetween.

Figure 10:
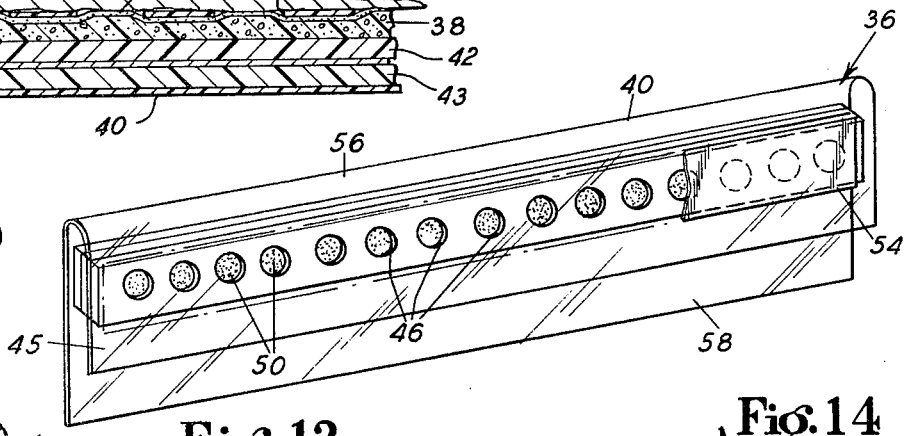
FIG. 10 is a perspective view of the supporting device of FIG. 7, as viewed from the mounting side thereof.

As best seen in FIG. 10, a mounting leg 45 of the backing band 40 is provided with a plurality of apertures 46, through which an adhesive layer 50 is exposed for mounting the device 36 on vertical support surface 52. The adhesive layer 50 is carried on the back of the spongy strip 38 and serves to secure the strip to an inside surface of the mounting leg 45 as well as providing the adhesive mounting areas for securing the device 36 to the vertical surface 52.

A releasable protective strip 54, similar to the protective strip 22, may be provided to protect the exposed adhesive areas prior to using the supporting device 36. The flexible backing band 40 includes a hinge portion 56 and a pull tab extension 58, similar to comparable elements of the FIG. 1 embodiment.

Figure 8:
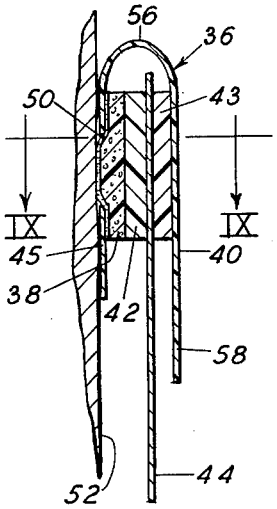
FIG. 8 is an enlarged sectional view taken generally along the line VIII—VIII of FIG. 7.
Figure 9:
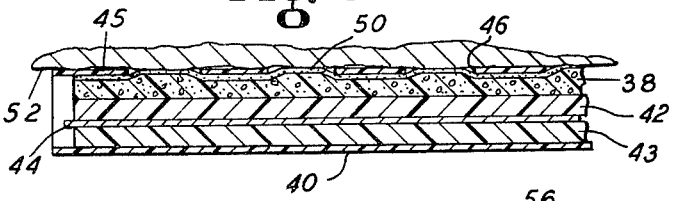
FIG. 9 is a fragmentary longitudinal sectional view taken along the line IX—IX of FIG. 8.

The supporting device 36 is especially well suited for being secured to a vertical surface which may be considerably more irregular than the surface on which the FIG. 1 embodiment may be mounted. Herein, when the protective strip 54 is removed to expose the adhesive layer 50 through the apertures 46, pressure is applied to deform the soft, spongy strip 38 through the apertures and against the vertical surface 52 as best seen in FIGS. 8 and 9. With this mounting arrangement the adhesive layer 50 can be brought into close contact with a mounting surface which may be quite rough.

As shown in FIG. 7 the supporting device 36 is well suited to temporarily display an information bearing piece which may be securely affixed to wall or door yet which is readily removed therefrom without damaging the support surface 52 or the display piece 44. A front face 60 of the flexible backing band 40 may be imprinted with significant indicia and the displace piece 44 imprinted with a message requiring changing from time to time. While the device 10 is shown as being narrow and the device 36 is shown to be wide it should be understood the width of either embodiment may be varied to meet particular requirements.

Figure 11:
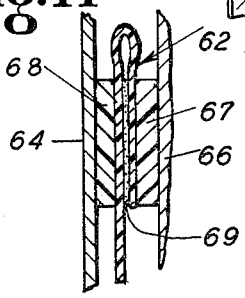
FIG. 11 is an end elevational view similar to FIG. 5, but showing the supporting device arranged to support a ferrous object from a ferrous support surface.
Figure 12:
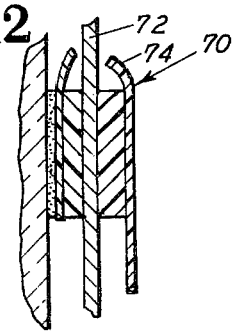
FIG. 12 is an end elevational view simialr to FIG. 11, but showing the supporting device arranged to provide intermediate support for a large advertising piece.
Figure 13:
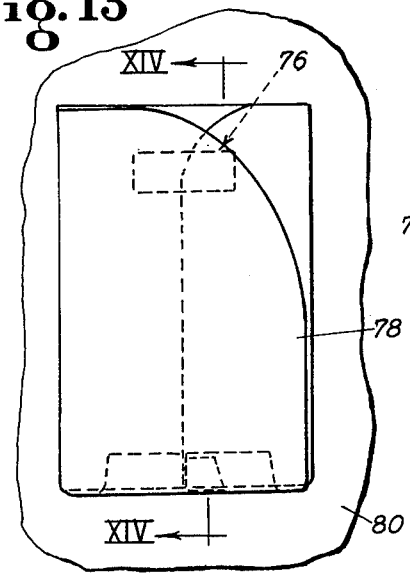
FIG. 13 is a front view of a display piece utilizing a portion of the supporting device for hanging the display piece from a ferrous support surface.

Now with specific reference to FIGS. 11 to 13 of the drawings it will be appreciated that our invention may be employed in various other useful purposes. For example in FIG. 11 support device 62 may be utilized to support a ferrous metal object 64 from a ferrous metal support surface 66. Herein, a pair of magnet strips 67 and 68 are affixed in back-to-back relationship with an adhesive layer 69.

FIG. 12 illustrates how a supporting device 70 may be utilized to support a advertising piece 72 at an intermediate position in which the flexible backing band is cut at its hinge portion 74 to permit the piece 72 to extend beyond the the device 70.

Figure 14:
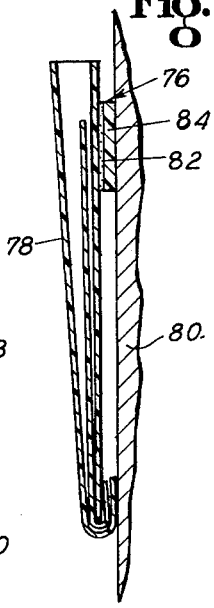
FIG. 14 is a sectional view taken generally along the line XIV—XIV of FIG. 13.

FIGS. 13 and 14 illustrate how a portion 76 of a support device may be incorporated with a display holder or envelope 78 or the like for affixing to a ferrous surface 80. The portion 76 may be identical to the mounted half of the supporting device shown in FIG. 5. An adhesive layer 82 secures the envelope 78 to the support device portion 76, while a magnet strip 84 similar to the strip 24, magnetically adheres to the metal surface 80. The envelope 78 may be used to provide a place to temporarily collect bills, shopping lists, keys, etc. Since the supporting device 76 is attached to and supports the envelope it is a simple matter to keep track of the magnetic strip which might otherwise be easily lost and the magnet is always in full contact with the metal supporting surface for maximum magnetic attraction thereto.

Various other modifications can of course be made in the supporting devices which have been illustrated and described without departing from the spirit of our invention, and it is intended that all such modifications be included within the scope of the appended claims.

We claim as our invention:

1. An advertising display means comprising:

a display piece, and a unitary temporary supporting device for supporting said display piece from a generally vertical surface comprising:

a pair of permanent magnet strips being magnetized to attract one another;

a flat flexible backing band having a mounting portion, a hinge portion and a release portion, said pair of magnet strips secured to said backing band in spaced paralled relationship, with a first of said pair of magnet strips carried on said mounting portion and a second of said magnet strips carried on said release portion; and a pressure sensitive adhesive layer associated with said mounting portion for affixing said supporting device to the vertical surface, said hinge portion of the backing band being foldable to position said pair of magnet strips in an aligned facing orientation whereby said display piece is clamped therebetween by magnetic forces for support from said vertical surface, said temporary supporting device further including a spongy pliable strip interposed between said mounting portion of said flexible backing band and said first of said pari of magnet strips, whereby the spongy pliable strip is deformable for affixing said adhesive layer to a irregular face of said vertical surface, while allowing the first of said pair of magnet strips to retain a parallel aligned orientation with said second of said pair of magnet strips.

2. The advertising display means according to claim 1, wherein said magnet strips comprise generally identical multiple pole strips.

3. The advertising display means according to claim 1, wherein said release portion of said flexible backing band induces a pull tab extension to accommodate separating said pair of magnet strips to release said display piece.

4. The advertising display means according to claim 3, wherein a removable protective strip overlays the adhesive layer prior to using the supporting device.

5. An advertising display means comprising:

a display piece, and a unitary temporary supporting device for supporting said display piece from a generally vertical surface comprising:

a pair of permanent magnet strips being magnetized to attract one another;

a flat flexible backing band having a mounting portion, a hinge portion and a release portion, said pair of magnet strips secured to said backing band in spaced parallel relationship, with a first of said pair of magnet strips carried on said mounting portion and a second of said magnet strips carried on said release portion; and a pressure sensitive adhesive layer associated with said mounting portion for affixing said supporting device to the vertical surface, said hinge portion of the backing band being foldable to position said pair of magnet strips in an aligned facing orientation whereby said display piece is clamped therebetween by magnetic forces for support from said vertical surface, said temporary supporting device further including a spongy pliable strip carried on said mounting portion and said second of said pair of magnet strips being bonded to one side of said spongy pliable strip and said adhesive layer carried on a second side of said spongy pliable strip for attachment to an inside surface of said mounting portion of said flexible backing band, said mounting portion being perforated with a plurality of longitudinally spaced apertures through which discrete areas of the adhesive layer are exposed for securing said supporting device to said vertical surface, whereby the spongy pliable strip is deformable to affix said discrete areas of said adhesive layer to said vertical surface while retaining a parallel aligned orientation between said first and second magnet strips.

6. A temporary supporting device for supporting an object from a generally vertical surface comprising:

a flat flexible backing band having a pair of opposing faces;

a pair of multi-pole permanent magnet strips bonded to a first face of said pair of opposing faces in parallel, spaced relation relative to one another with each of said magnet strips having a plurality of spaced magnetized bands of alternating polarity extending across a face thereof;

with one of said magnet strips having a soft, spongy, pliable layer connected between said magnet strip and the adjoining face of said backing band; and a pressure-sensitive adhesive layer carried on a second face of said pair of opposing faces and generally opposite to said one of said pair of magnet strips, said adhesive layer being arranged to affix said supporting device to said vertical surface;

wherein said flexible backing band is folded to bring said magnet strips into face-to-face clamping alignment with alternating polarity magnetized bands of each magnet strip disposed in positions of juxtaposed magnetic attraction therebetween to insure clamping alignment of said magnet strips whereby said object is clamped between said magnet strips and wherein said pressure-sensitive adhesive layer is pressed against said vertical surface to affix said supporting device thereto to support said object from said vertical surface.

7. A temporary supporting device for supporting a display piece from a generally vertical surface comprising:

a flat flexible backing band having a mounting portion, a hinge portion and a release portion, said mounting portion being perforated with a plurality of longitudinally spaced apertures;

a spongy pliable strip carried on said mouning portion of said backing band;

a pair of identical, multipole, permanent magnet strips being magnetized to attract one-another, a first of said pair of magnet strips bonded to said spongy pliable strip and a second of said pair of magnet strips bonded to said release portion of said flexible backing band; and a pressure sensitive adhesive layer carried on said spongy pliable strip for affixing said spongy pliable strip and said first magnet strip carried thereon to said mounting portion, portions of said adhesive layer being exposed through said spaced apertures for mounting said supporting device on said vertical surface, said hinge portion being folded to position said pair of magnet strips in an aligned face-to-face clamping orientation whereby said display piece is clamped between said pair of magnet strips by magnetic forces to support said display piece from said vertical surface.

8. A method of temporarily supporting an advertising piece with a supporting device from an irregular face of a generally vertical surface comprising the steps of:

positioning an advertising piece over a first permanent magnet strip which is affixed at one end to a face of a flat flexible backing band;

folding over said flexible backing band to bring a second permanent magnet strip, being opposite in polarity to that of said first magnet strip and affixed to a spongy pliable strip which is secured to said face at another end of said backing band, into face-to-face alignment with said first magnet strip;

bringing said first and second magnet strips into magnet attractive orientation to clamp said advertising piece therebetween;

removing a protective strip from an adhesive layer carried on said flexible backing band on a second face thereof and opposed to said first magnet strip to expose said adhesive layer;

pressing said adhesive layer against said vertical surface to affix said supporting device thereto to temporarily support the advertising piece from said vertical surface; and compressively deforming portions of said spongy pliable strip for allowing said adhesive layer to conform to said irregular face of said vertical surface while allowing said first magnet strip to retain a flat parallel orientation with respect to said second magnet strip.

* * * * *